United States Patent [19]

Piazza

[11] 4,133,859

[45] Jan. 9, 1979

[54] PROCESS AND APPARATUS FOR MAKING A PLURALITY OF BUILDING MODULES

[75] Inventor: Matthew R. Piazza, Nichols, Conn.

[73] Assignee: Maso-Therm Corporation, Bridgeport, Conn.

[21] Appl. No.: 810,449

[22] Filed: Jun. 27, 1977

[51] Int. Cl.[2] ..... B28B 1/08

[52] U.S. Cl. ..... 264/71; 264/157; 264/163; 264/256; 264/297; 264/DIG. 57; 425/63; 425/219

[58] Field of Search ..... 264/DIG. 57, 157, 160, 264/163, 256, 297, 69, 70, 71, 72; 425/63, 219

[56] References Cited

U.S. PATENT DOCUMENTS

| | | | |
|---|---|---|---|
| 2,235,001 | 3/1941 | Allen | 264/297 X |
| 2,644,217 | 7/1953 | Agar | 264/163 X |
| 3,217,375 | 11/1965 | Kinnard | 264/DIG. 57 |
| 3,271,497 | 9/1966 | Elgenstierna | 264/256 X |
| 3,295,278 | 1/1967 | Muhm | 264/256 X |
| 3,507,738 | 4/1970 | Prusinski | 264/71 X |

*Primary Examiner*—Thomas P. Pavelko

*Attorney, Agent, or Firm*—Sprung, Felfe, Horn, Lynch & Kramer

[57] ABSTRACT

A process and apparatus for making a plurality of building modules each having an insulating foam core encased in a shell of fiber reinforced cementitious material. A longitudinal casting zone is provided having continuous side rails and end-to-end base members having lengths corresponding to the lengths of the modules being formed. A continuous bottom layer of fiber reinforced cementitious material is cast over the base members and extending the length of the casting zone. The bottom layer is divided into lengths and lateral end members are inserted between the side rails in the spaces between the divided bottom layer lengths. A foam core is placed on each bottom layer length and wet fiber reinforced cementitious material is successively applied over the entire length of the casting zone so as to fill in the free spaces surrounding each core member and cover it with a layer of cementitious material thereby completely encasing each core member. The casing around each core is allowed to cure to a point where it is self-supporting and the individual modules are withdrawn, allowed to completely cure and are separated from the base members.

11 Claims, 10 Drawing Figures

PROCESS AND APPARATUS FOR MAKING A PLURALITY OF BUILDING MODULES

BACKGROUND OF THE INVENTION

The present invention relates to a process and an apparatus for making a plurality of building modules each having an insulating foam core encased in a shell of fiber reinforced cementitious material.

Building modules having an insulating foam core encased in a shell of fiber reinforced cementitious material are especially useful in building applications since they have a similar appearance to monolithic cast concrete modules and yet have significant improvements in insulating properties and weight reduction.

Because of increased costs in material and labor, the construction industry has come to use prefabricated building modules for many applications and has sought a simple and economical process and apparatus for makir, a plurality of these building modules in a continuous process.

SUMMARY OF THE INVENTION

The present invention provides process and apparatus for making a plurality of building modules in a simple and economical manner.

This is achieved by the process and apparatus of the present invention which includes providing a longitudinal casting zone having continuous side rails and end-to-end base members having lengths corresponding to the lengths of the panels being formed, casting a continuous layer of wet fiber reinforced cementitious material over the base members and extending the entire length of the casting zone, dividing the continuous layer laterally at the juncture between the end-to-end base members, and withdrawing the individual panels each supported on a base member from the casting zone. The supported panels are allowed to cure and are separated from the base members which are then reused in the casting zone. In a preferred embodiment, the continuous layer is cast with vibration.

A foam core member may then be placed on each of the bottom layer lengths, with the foam core member having a peripheral shape smaller than the surface of the bottom lengths so as to leave a free space between the core member, the side rails and the end members. The core member has a height less than the height of the side rails. Thereafter, fiber reinforced cementitious material is successively applied to the entire length of the casting zone so as to fill in the free space surrounding each core member and to cover each core member with wet fiber reinforced wet cementitious material thereby completely encasing each core member. The encased core member may then be allowed to cure to a point where it is self-supporting and it is then withdrawn from the casting zone still supported on the base member and allowed to completely cure wherein the base members are separated and recycled to the casting zone.

BRIEF DESCRIPTION OF THE DRAWINGS

The present invention will be more fully understood from the following description taken in conjunction with the accompanying drawings wherein.

DETAILED DESCRIPTION OF THE PREFERRED EMBODIMENTS

Figure 1A:
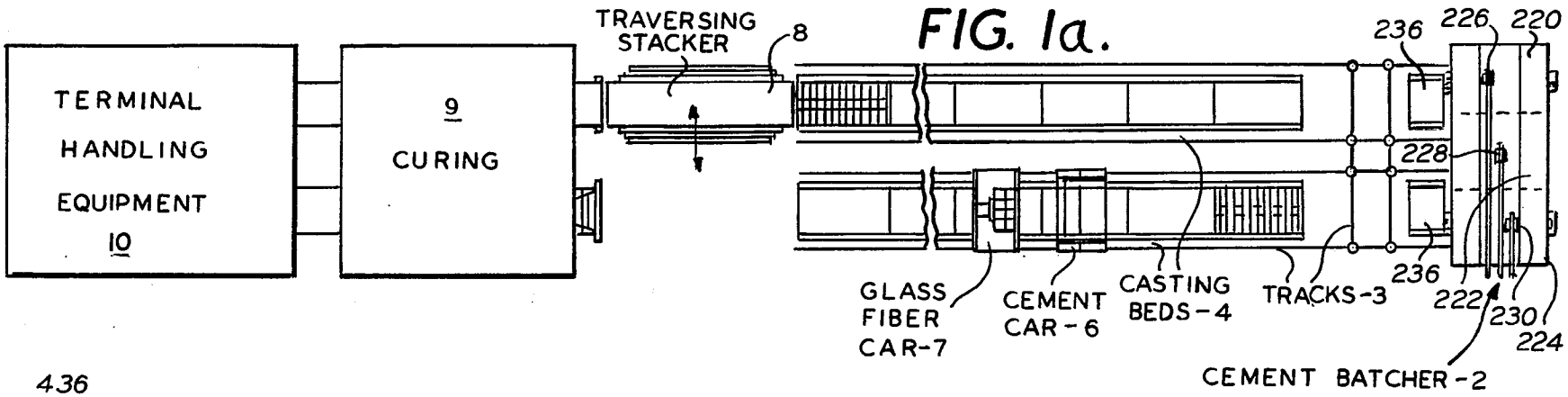
FIG. 1*a* is a top view of the apparatus of the present invention.

As shown in FIG. 1*a*, the system includes a cement batcher 2 which receives the various components of the cementitious material for mixing same. Cement car 6 travels on horizontal tracks 3 for positioning under cement batcher 2 as in FIG. 2, and for depositing the cementitious material on casting beds 4.

Also provided in glass fiber car 7 which travels on tracks 3 for depositing chopped or cut fibers into the wet cementitious material to obtain a fiber reinforced cementitious material.

After the panels are formed on casting beds 4, they are conveyed on the casting bed to entry stacker and traverse car 8 to transfer and lift the panels onto curing racks for the curing thereof at curing station 9. From the curing station, the cured panels are transferred to an exit stacker similar to car 8 where they are unloaded and stacked. The terminal handling equipment 10 separates the panels from the forms and transports the separated panels and forms so as to stack the panels on pallets and bind the panels to the pallets for shipping.

Figure 2:
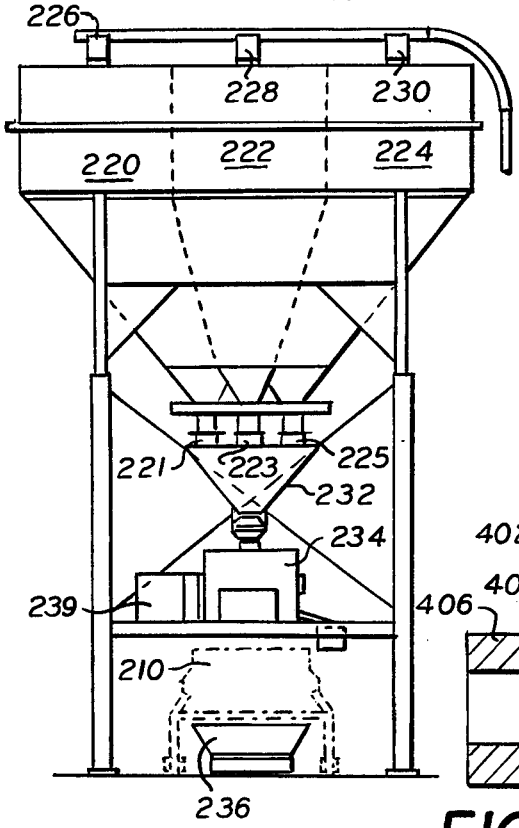
FIG. 2 is a front view of the cement batcher.

The cement batcher 2, as shown in FIGS. 1*a* and 2, stores and automatically dispenses measured amounts of raw materials into a mixer. The raw materials are supplied through inputs 226, 228 and 230 into compartments 220, 222, and 224, respectively. Desired amounts of the various materials in compartments 220, 222, and 240 are delivered through outputs 221, 223 and 225 respectively into hopper 232 where it is then supplied to mixer 234 driven by gear motor 239. The mixed cementitious material is then dispensed into cement car 6 and a drain pan 236 is provided thereunder.

The cementitious material is preferably common cement in admixture with conventional fillers such as sand or pumice and can contain conventional additives such as lime and stearates for water resistance, latex for added strength and wetting ability with respect to the fiber reinforcement, and water reducing agents such as pozzilith for quick setting. Conventional tints or dyes can also be used to provide the desired coloration. It is also possible to use as a cementitious material, a sulfur based product marketed under the trademark Cument by Chevron Chemical Company. This sulfur based material can be used in admixture with sand or other conventional fillers following known techniques for handling this type of material.

Figure 8:
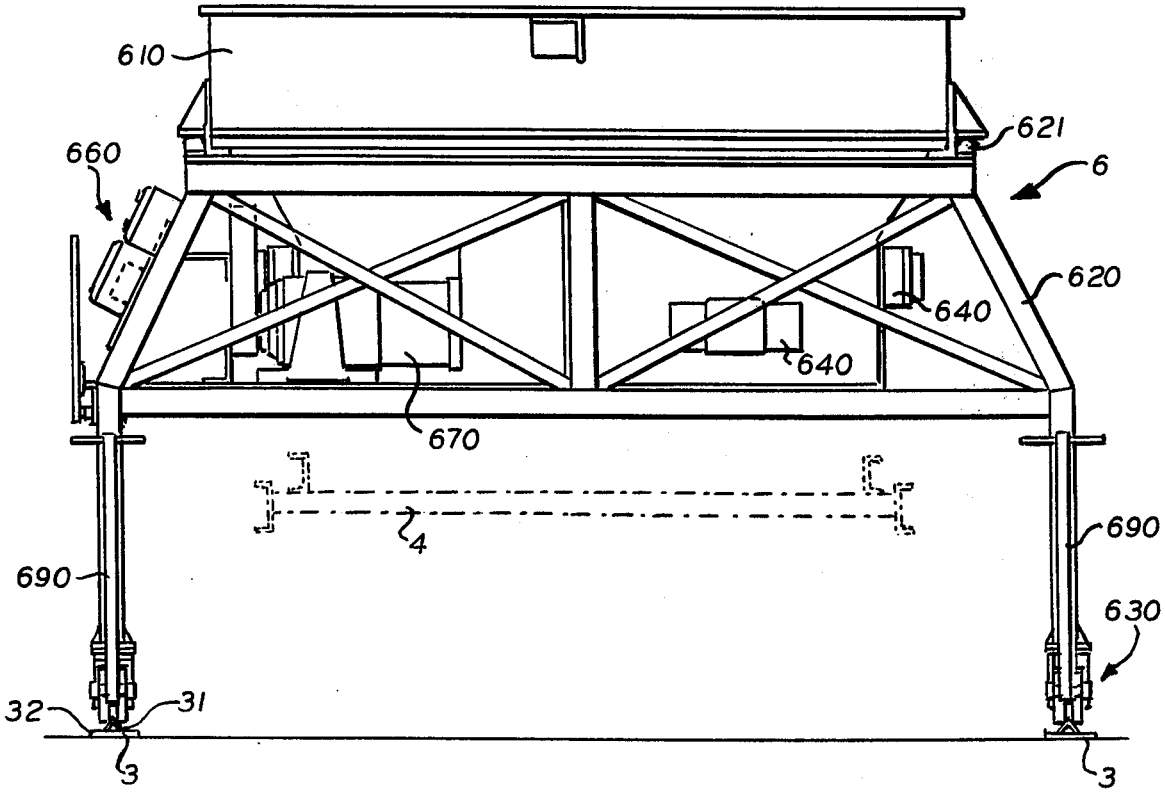
FIG. 8 is a front view of the cement car.
Figure 4:
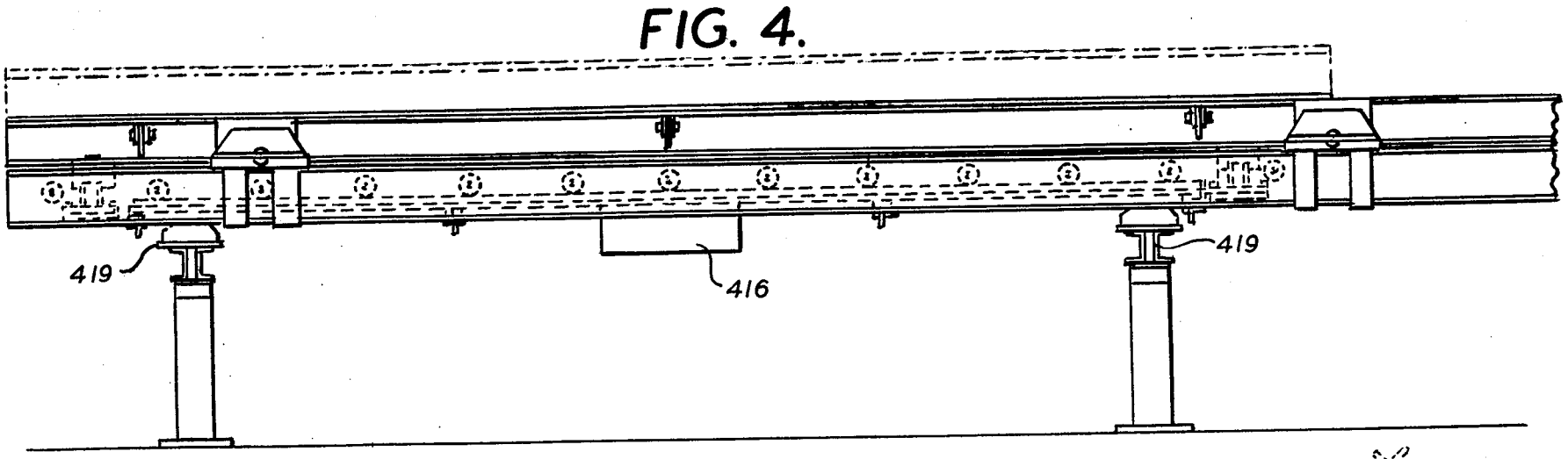
FIG. 4 is a side view of the casting bed.

The track system 3 as shown in FIGS. 1*a* and 8 includes both longitudinal and transverse tracks comprising an inverted V-shaped design preferably constructed of an angle iron 31 and a steel plate 32. The transverse tracks can be used for a shuttle car while the longitudinal tracks are used to move the glass fiber car 7 and the cement car 6 along and over the casting beds 4.

The casting beds 4 are described with reference to FIGS. 1*a* and 3–7. As shown therein, on the casting bed 4 a rigid urethane foam core 15 is encapsulated by fiber reinforced cement 16. The casting bed includes form rails 401 and a plurality of gravity rollers 411 mounted between conveyor frames 412.

Figure 5:
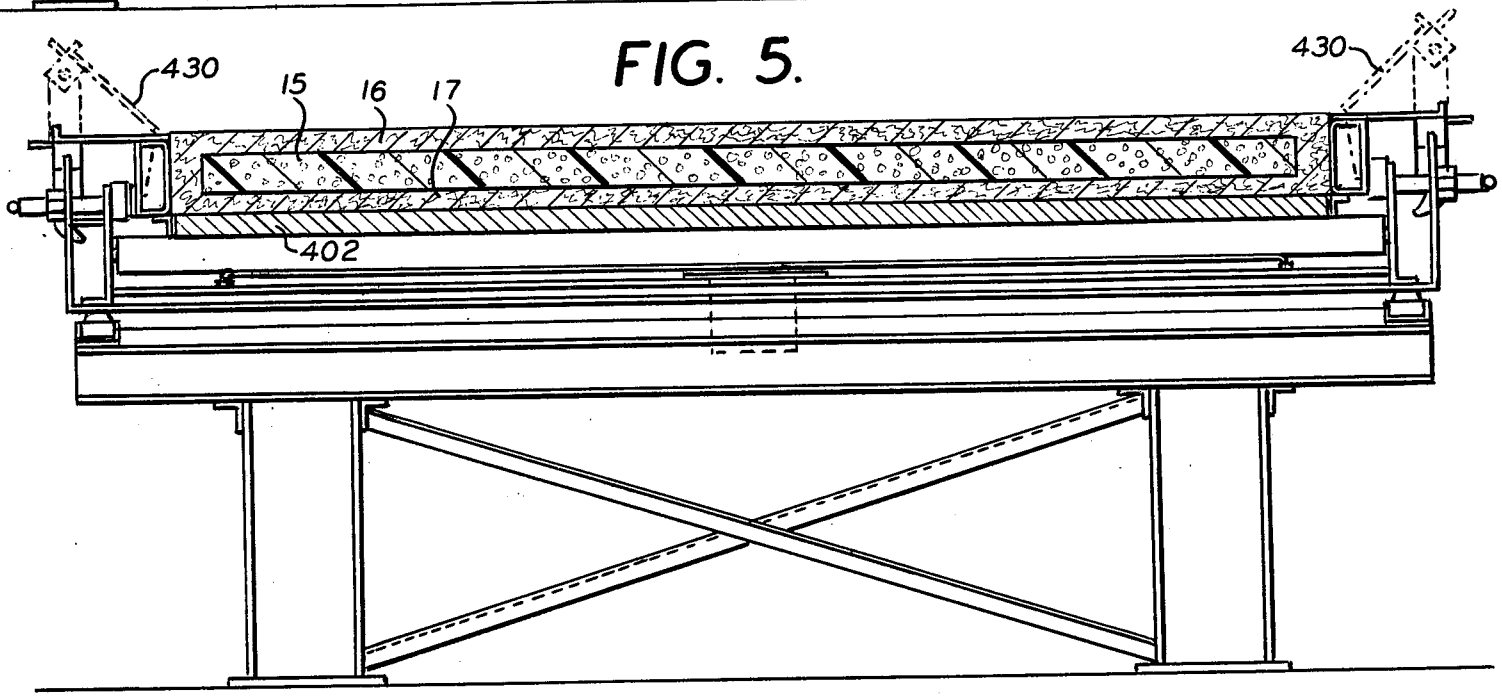
FIG. 5 is a cross-sectional view of the casting bed of FIG. 4.
Figure 6:
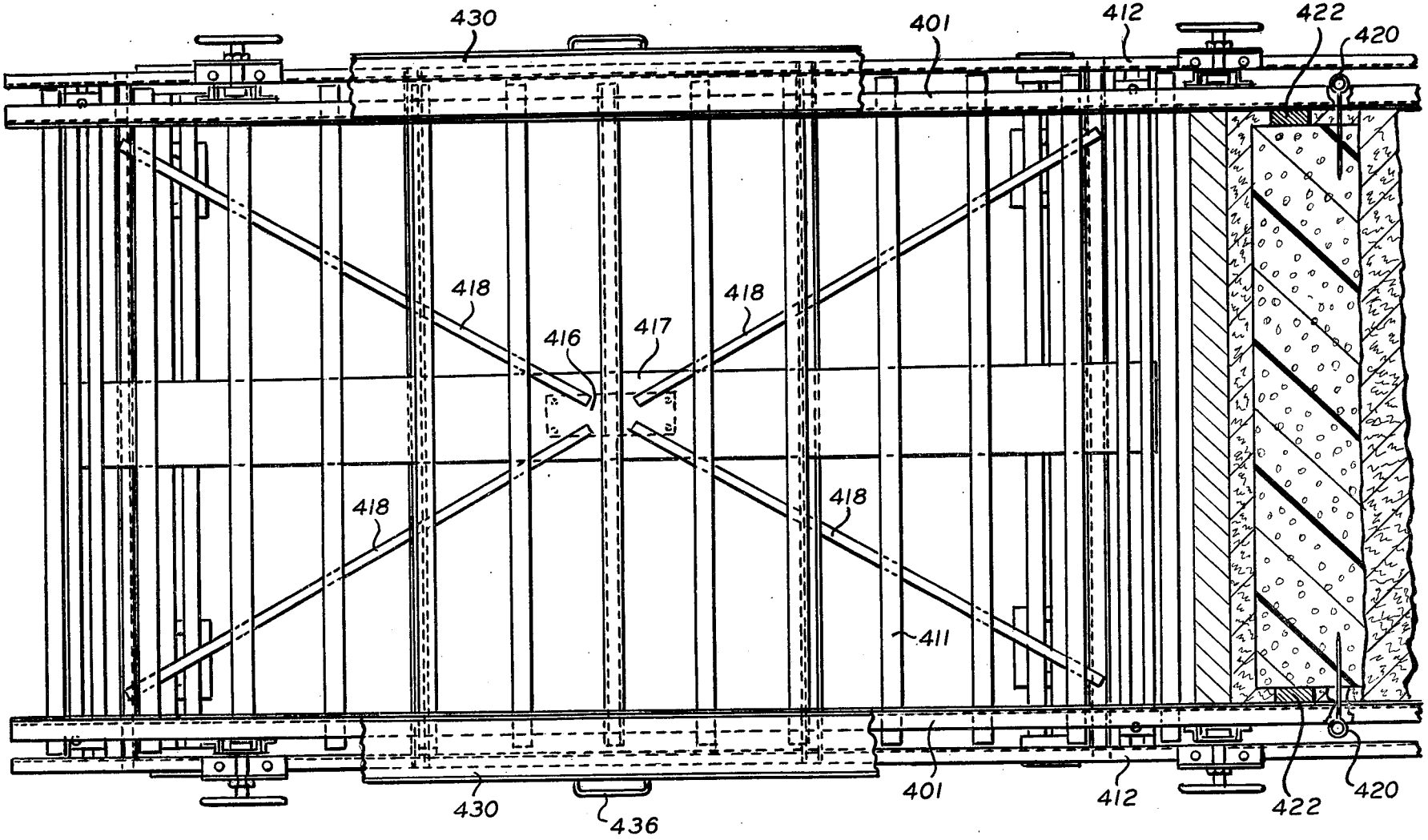
FIG. 6 is a top view of the casting bed of FIG. 4.

Base members 402 are placed on the gravity rollers 411 between form rails 401 as shown in FIG. 5 and a bottom layer 17 of cementitious material is cast thereon. Thereafter the rigid foam core 15 is placed on the bottom layer and the rigid foam core is maintained in place during succeeding applications of cementitious material by which are inserted through apertures 421 (FIG. 3*a*) and into the foam core 15 to prevent the core from rising. Additionally, as shown in FIG. 6, spacing blocks 422 are disposed between the foam core and form rails 401 and member 451 to prevent displacement.

A vibrator 416 is also supplied beneath the frame and is attached to a vibrator mounting plate 417 and angle iron braces 418 connected to the conveyor side frames for the transfer of the vibration to the casting bed. Vibration isolators 419 are provided between the frame of the casting bed and the support structure to vibrationally isolate the floor from the casting bed.

Figure 7:
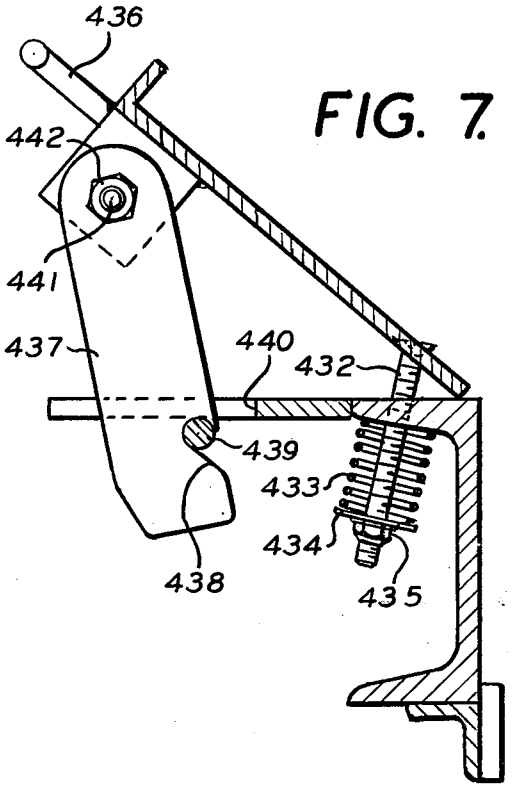
FIG. 7 is a cross-sectional view of the cement deflector.

The casting bed also includes cement deflectors 430 mounted on the form rails 401. The cement deflectors 430 are pivotally mounted on screws 432 which are spring loaded via spring 433 and washer 434 and nut 435 to maintain the deflecting plate in the down position wherein plate 430 is adjacent to the top portion 440 of the form rail. The cement deflector is raised to the position shown in FIG. 6 by handle 436 and is maintained in the deflecting position by locking member 437 pivotable about screw 441 held by nut 442 and having notch 438 which engages pin 439 to maintain plate 430 at an acute angle with respect to form rail portion 440. The cement deflector has the function permitting cementitious material and fibers to be simply and accurately disposed in the space between the core member and form rails 401. When the cement deflector is in the deflecting position as shown in FIG. 7, cement and fibers are deposited thereon and the cement deflector plate 430 is vibrated along with the casting bed. The fibers and cement that are on the plate 430 thereby slide down and into the space between the core and the form rails 401. The plate 430 can be easily cleaned by putting it in the down position.

Cement car 6, shown in FIG. 8, includes hopper 610 which receives the cement mixture from the cement batcher 2. The frame 620 is preferably constructed from structural steel tubing and channel and angle iron and is rigidly braced and has vibration isolators 621 to isolate the hopper 610 from the remainder thereof. The legs 690 support casters 630 which run on the tracks 3.

The cement car also includes an agitator 670 which preferably has a three-phase in-line gearmotor and a vibrator 640. The agitator and vibrator are controlled by electrical controls 660 which comprises a master disconnect switch and all the necessary operational controls for the unit.

The fiberglass car 7 is similar in construction to the cement car 6 and includes spray nozzles for insuring uniform controlled spray of glass fiber onto the cementitious material. The cement car also includes a glass fiber cutter for cutting the supply of glass fiber into rovings of desired length. The car is further disclosed in copending application Ser. No. 810,451, filed June 27, 1977, now U.S. Pat. No. 4,123,212 issued Oct. 31, 1978.

Figure 3A:
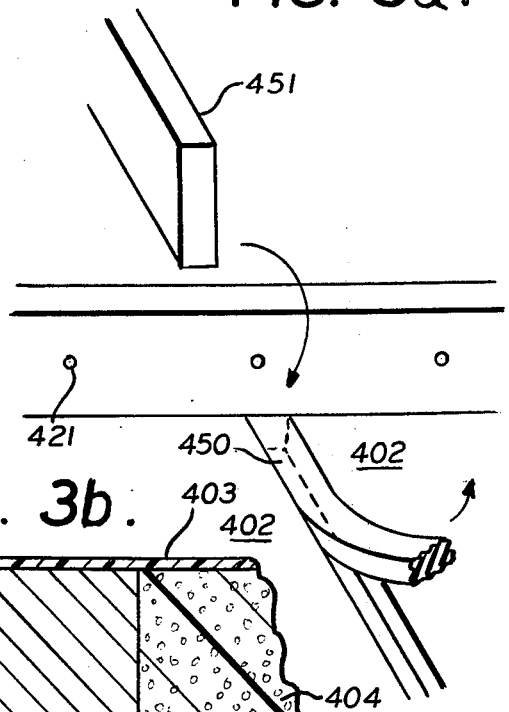
FIG. 3*a* is a detailed view of adjoining base members.
Figure 3B:
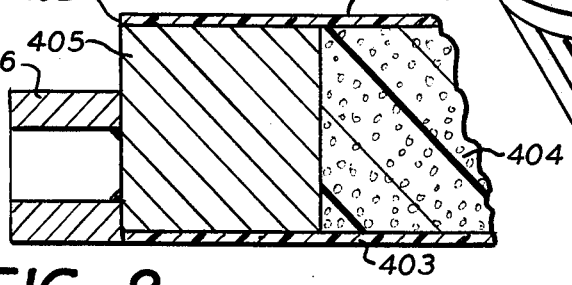
FIG. 3*b* is a partial cross-sectional view of a base member.

In the process for making a plurality of building modules having an insulating foam core 15 encased in a shell 16 of fiber reinforced cementitious material, a casting zone is defined between the form rails 401 for the width and base members 402 for the length. Base members 402 preferably comprise planar panels having aluminum side members 405 and a foam center 404 covered with plastic sheets 403 at the top and bottom. An adjoining side portion 406 is preferably wood and has a height shorter than the remaining base member. The base members excluding the side portions 406 define the length of the panel to be formed. A spacing member 450 is disposed on top of two adjoining side portions 406 to fill the space above the two and be flush with the top of the base member. The spacing member 450 is preferably flexible and composed of a hard rubber. After the first layer of cementitious material is spread onto the base members and before the foam core is placed thereon, the spacing member 450 is removed and a mold member 451 is inserted in the space left by the removal of spacing member 450 (FIG. 3*a*). Mold member 451 extends above the top of the base member to the height of the finished panel and is preferably composed of wood and is used to form the mold to hold the cementitious material which will form the shell about the foam core.

Thus the bottom layer is first cast continuously over the base members 402 and mold members 450 with a wet cementitious material having a matrix of randomly interconnected fiber reinforcement which is cast by successively applying wet cementitious material from cement car 6 and chopped fiber from glass fiber car 7 to the length of the casting zone base on casting bed 4. The cementitious material is rolled by rollers 500 so as to wet the fibers with the cementitious material.

When the spacing members 450 are removed from the base members 402, the bottom layer 17 is thus divided into lengths corresponding to the lengths of the modules being formed and the lateral end mold members 451 are inserted between the side rails in the spaces above side portions 406 and partially between base members 402. At this point, more fiber reinforced cementitious material may be applied to obtain a panel of glass reinforced concrete if desired. GRC has applications for many products such as cladding panels, permanent formwork, tunnel linings, street and garden furniture, air ducts, refuse shutes, pipes, small buildings and storage vessels. It can be made from gray, white or brown Portland cement and other specialty cements and can have profiled, high relief or textured surfaces. Alternatively, the foam core 15 is then placed on each bottom layer length 17 and the foam core has a peripheral shape that is smaller than the surface of the bottom layer length 16 so as to leave a free space between the core, the side form rails 401 and the end mold members 451. The core also has a height less than the side rails to enable a top layer to be cast thereover. Pins 420 are inserted into the core members to maintain the core members in place and prevent it from rising and spacing members 422 are also inserted. Wet cementitious material and chopped fibers are successively applied to the entire length of the casting zone including deflector plates 430 so as to fill the free spaces surrounding each core member and to cover each core member with wet cementitious material having a matrix of randomly interconnected fiber reinforcement thereby completely encasing each core member.

The fiber reinforced cementitious material encasing each core is allowed to cure to a point where it is self-supporting and then the individual modules are withdrawn and each, supported on its base member longitudinally from the casting zone, is then completely cured and separated from its base member which is then recycled to the casting zone.

In an alternative embodiment, the core member is wrapped in a scrim material prior to being placed on the bottom layer lengths as disclosed in copending application Ser. No. 754,877 filed Dec. 27, 1976.

Additionally, in any of the above embodiments, in order to insure a proper random distribution of the fibers in the cementitious material, the vibrator 416 is operated to vibrate the mixture of cementitious material and fiber.

The fibrous reinforcement in fiber form is preferably glass fiber chopped from rovings in lengths of one-quarter to three inches and preferably from one to two inches. A preferred glass fiber is AR (alkali resistant) glass fiber sold under the trademark CEM-FIL and more particularly described in U.S. Pat. No. 3,901,720.

For glass reinforced concrete (GRC), the generally recognized glass content is about 5% by weight with the glass fibers being distributed in an interconnected random matrix. The interconnection results from a physical or mechanical, cohesive interstates between glass fibers which is enhanced when the cementitious material cures around the foam core and shrinks putting the interconnected matrix in tension.

Other similar and equivalent fibrous materials can be used for the fibrous reinforcing materials within the context of the present invention. For example, the fiber can be made of conventional E glass fiber, (including E glass fiber-coated to impart alkali resistance to the glass for example with a polyester coating), AR glass such as described above, aramid fibers, nylon fibers, polyester fibers and the like including natural and synthetic inorganic and organic fibers, for example, graphite fibers.

The scrim material that can be used to wrap the rigid foam core is preferably aramid fiber (e.g., Kavlar—DuPont) and it is used to reinforce the interaction of the cement shell on the foam. The scrim reinforcement can be just below the surface of the shell so that it is thoroughly imbedded in the cement and glass fiber to insure maximum reinforcement. In other words, the glass fiber matrix and the scrim reinforcement should be thoroughly wetted by the cementitious material.

The term scrim is used herein to include woven, non-woven and dense chopped fiber layers which functions as a reinforcing layer with respect to composite modules made by the invention. The scrim material can be coarse or fine so long as it is sufficiently open to allow the cementitious mixture to penetrate and wet the scrim layer itself. Generally, the scrim reinforcing material will have a screen-like appearance with openings as small as an eighth of an inch up to two inches or more, preferably with openings of about a quarter of an inch up to one inch. Naturally, the type and configuration of the scrim reinforcing material will depend upon the ultimate use for the module being produced. For panels measuring approximately five by ten feet and four inches thick, a single layer of aramid fiber scrim with openings of approximately one-half inch either surrounding the foam core or adjacent to the major surfaces, that is the front and back of the panel has been found to provide adequate reinforcement for these particular applications.

Figure 1B:
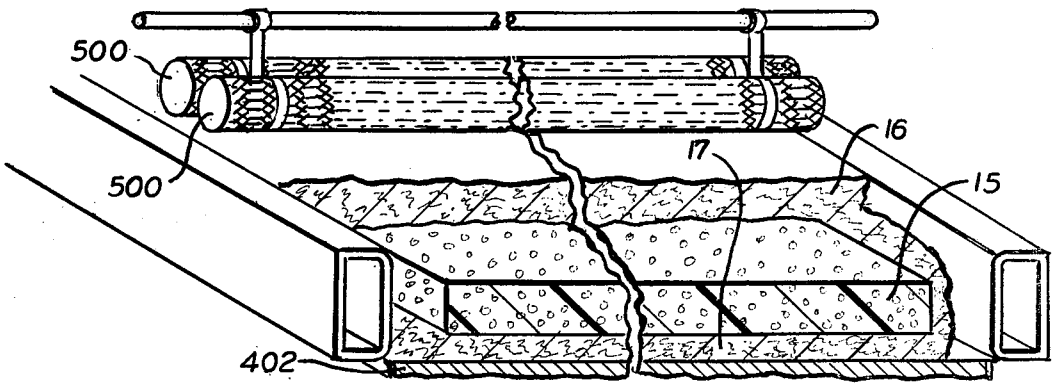
FIG. 1*b* is a perspective view of rollers used to wet fibrous reinforcement with cementitious material.

Because of availability and cost, the preferred fibrous reinforcement is glass fiber and preferably AR glass fiber and the scrim reinforcing material is preferably an aramid scrim fiber such as described above. However, other similar and equivalent fibrous materials can be used for the fibrous reinforcing materials within the context of the present invention. For example the fiber and/or scrim reinforcing materials can be the same or different. Mechanical treatments are employed to work the glass fiber matrix and/or scrim reinforcing material into the wet cement mixture. For example, in FIG. 1b rollers 500 made of wire, grid or mesh can be applied to the mixture of glass fiber and cement and/or the scrim reinforcing material to insure thorough wetting of the reinforcing materials by the cement. The use of dilute latex can also assist in the wetting operation.

Suitable rigid foams include inorganic and organic foams. Rigid urethane polymer foams are preferred and these well-known materials are widely used principally for insulation purposes. Urethane polymer foams are commonly formed by combining the reactants (a polyol and an isocyanate) using airless spraying or liquid application techniques. Foaming commences almost instantaneously and is completed within a very short time depending on the type of urethane polymer composition employed. The density of rigid urethane foams also depends on the nature of the urethane composition employed but generally ranges between about 1.5 pounds per cubic foot to ten pounds per cubic foot, more commonly from 2 to 5 pounds per cubic foot. Other suitable rigid foams include polyester foams, phenolic resin foams, isocyanurate foams and sulfur-based foams marketed under the trademark SUFOAM by Chevron chemical company.

As mentioned previously, it is preferred to form the cement glass fiber matrix reinforced shell by successively depositing chopped glass fibers and wet cement while vibrating the mold. This insures complete wetting of the glass fibers by the cement without disturbing the glass matrix and also thorough filling of the free space between the core member and the sides of the mold.

After fabrication of the module is complete the cement is allowed to cure under ambient conditions or preferably in a steam heated curing enclosure. Curing can also be accelerated using hot wet cement made with water at about 122° to 200° F. Once the cement is cured the composite module is processed as explained above.

Typical properties of commercially available rigid urethane polymer foams are set forth in the following table:

TYPICAL RIGID URETHANE FOAM PROPERTIES

| Density lb./cu.ft. Astm D 1622 | Compressive Strength psi Astm D 1621 | Compressive Modulus psi Astm D 1621 | Shear Strength psi | Shear Modulus psi |
|---|---|---|---|---|
| 1.5–2.0 | 20–60 | 400–2000 | 20–50 | 250–550 |
| 2.1–30 | 35–95 | 800–3500 | 30–70 | 350–800 |
| 3.1–45 | 50–185 | 1500–6000 | 45–125 | 500–1300 |
| 4.6–70 | 100–350 | 3800–12,000 | 75–180 | 850–2000 |

What is claimed is:

1. Process for making a plurality of building modules each having an insulating foam core encased in a shell of fiber reinforced cementitious material which comprises:

(a) providing a longitudinal casting zone having continuous side rails and end-to-end base members having lengths corresponding to the lengths of the modules being formed;

(b) casting a continuous bottom layer over the base members and extending the length of the casting zone, said layer comprising wet cementitious material having a matrix of randomly interconnected fiber reinforcement which is cast by successively applying wet cementitious material and chopped fiber to the length of the casting zone base;

(c) dividing said bottom layer into lengths corresponding to the lengths of the modules being formed and inserting lateral end members between the side rails in the spaces between the divided bottom layer lengths;

(d) placing foam core members on each of the bottom layer lengths, said foam core members having a peripheral shape smaller than the surface of the bottom lengths so as to leave a free space between the core member, the side rails and the end members, said core member having a height less than the height of the side rails;

(e) successively applying wet cementitious material and chopped fiber to the entire length of the casting zone so as to fill the free space surrounding each core member and to cover each core member with wet cementitious material having a matrix of randomly interconnected fiber reinforcement thereby completely encasing each core member;

(f) allowing the fiber reinforced cementitious material encasing each core to cure to a point where it is self supporting and withdrawing the individual modules each supported on a base member longitudinally from the casting zone, allowing the support modules to completely cure and separating said base members for recycle to the casting zone.

2. Process of claim 1 wherein the base members form lateral grooves when placed end-to-end in the casting zone, insert members are placed in each groove so as to provide a substantially flat surface over which the continuous bottom layer is cast, said insert members being removed to divide the bottom layer in step (c) and provide the spaces for receiving the lateral end members.

3. Process of claim 1 wherein the wet cementitious material contains from about one to two percent by weight premixed fiber reinforcement.

4. Process of claim 1 wherein the core members are each wrapped in a scrim material prior to step (d).

5. Process of claim 1 wherein steps (b) and (e) are carried out with vibration.

6. Process of claim 1, further comprising providing downwardly sloping cement deflectors along the longitudinal sides of the casting zone and wherein step (e) includes applying the wet cementitious material and chopped fiber onto the cement deflectors to slide down same into the free spaces between the foam core and the longitudinal sides of the casting zone.

7. Process of claim 1, further comprising after step (d), inserting holding pins into the vertical sides of the core members and perpendicular to the longitudinal sides of the casting zone to prevent the rising up of the core members.

8. Process according to claim 1, further comprising after step (d), inserting spacing members between the foam core and both the longitudinal sides of the casting zone and the lateral end members.

9. Process for making a plurality of composite cementitious panel members each reinforced with a randomly interconnected fiber matrix which comprises:

(a) providing a longitudinal casting zone having continuous side rails and end-to-end base members having lengths corresponding to the lengths of the panels being formed;

(b) casting a continuous layer over the base members and extending the entire length of the casting zone, said continuous layer comprising wet cementitious material having a matrix of randomly interconnected fiber reinforcement which is cast by successively applying wet cementitious material and chopped fiber to the length of the casting zone base;

(c) dividing the continuous layer into discrete unconnected lengths of panels by inserting lateral members between the side rails, before casting the bottom layer in step, laterally at the juncture between said end-to-end base members and removing the lateral members, after casting together with the overlying portion of the layer formed in step (b);

(d) withdrawing the individual panels from the casting zone each supported on their associated base members.

10. Process of claim 6 wherein the wet cementitious material contains from 1 to 2 percent by weight premixed fiber reinforcement.

11. Process of claim 7 wherein the continuous layer is cast in step (b) with vibration.

* * * * *

UNITED STATES PATENT AND TRADEMARK OFFICE

CERTIFICATE OF CORRECTION

PATENT NO. : 4,133,859
DATED : January 9, 1979
INVENTOR(S) : Matthew R. Piazza

It is certified that error appears in the above-identified patent and that said Letters Patent are hereby corrected as shown below:

Col. 1, l. 19-20, "makin" should read -- making --

Col. 3, l. 10, insert -- pins 420 -- after "by"

Col. 8, l. 34, insert -- (b) -- after "step"

Signed and Sealed this

*Nineteenth* Day of *June 1979*

[SEAL]

*Attest:*

RUTH C. MASON
*Attesting Officer*

DONALD W. BANNER
*Commissioner of Patents and Trademarks*